US011389941B2

(12) United States Patent
Blatz

(10) Patent No.: US 11,389,941 B2
(45) Date of Patent: Jul. 19, 2022

(54) SWITCH FOR MACHINE TOOL AND SWITCHING LOGIC

(71) Applicant: Hilti Aktiengesellschaft, Schaan (LI)

(72) Inventor: Thomas Blatz, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 106 days.

(21) Appl. No.: 17/045,020

(22) PCT Filed: Mar. 20, 2019

(86) PCT No.: PCT/EP2019/056925
§ 371 (c)(1),
(2) Date: Oct. 2, 2020

(87) PCT Pub. No.: WO2019/197123
PCT Pub. Date: Oct. 17, 2019

(65) Prior Publication Data

US 2021/0146523 A1 May 20, 2021

(30) Foreign Application Priority Data

Apr. 9, 2018 (EP) ..... 18166226

(51) Int. Cl.
*B25F 5/02* (2006.01)
*B24B 23/02* (2006.01)
*B25F 5/00* (2006.01)

(52) U.S. Cl.
CPC ..... *B25F 5/02* (2013.01); *B24B 23/02* (2013.01); *B25F 5/001* (2013.01)

(58) Field of Classification Search
CPC ..... B25F 5/02; H01H 3/20
See application file for complete search history.

(56) References Cited

U.S. PATENT DOCUMENTS 3,847,233 A * 11/1974 Glover ..... H01H 3/20 200/318.2
4,180,716 A * 12/1979 Suzuki ..... H01H 9/06 200/522

(Continued)

FOREIGN PATENT DOCUMENTS

CN 100455389 C 1/2009
CN 101479821 A 7/2009

(Continued)

OTHER PUBLICATIONS

International Search Report of PCT/EP2019/056925, dated Jun. 26, 2019.

*Primary Examiner* — Eyamindae C Jallow
(74) *Attorney, Agent, or Firm* — Davidson, Davidson & Kappel, LLC

(57) ABSTRACT

A method for controlling a machine tool-having an operating switch and a lock switch including:

activating the operating switch by exerting a force in a direction onto the operating switch for switching over the machine tool from a deactivation mode to an activation mode, so that the drive is adjusted to a first predetermined rotation speed value;

deactivating the operating switch, so that no more force is exerted in direction onto the operating switch, wherein the drive is adjusted in the first predetermined rotation speed value for a predetermined time period;

activating the lock switch within the first predetermined time period after deactivation of the operating switch, so that the drive is adjusted to a predetermined second rotation speed value; and activating the operating switch by exerting a force in a direction onto the operating switch or activating the lock switch by exerting a force in a direction onto the (Continued)

lock switch for switching over the machine tool from the activation mode to the deactivation mode.

16 Claims, 9 Drawing Sheets

(56) References Cited

U.S. PATENT DOCUMENTS

| | | | | |
|---|---|---|---|---|
| 4,763,101 | A | 8/1988 | Bauer et al. | |
| 4,879,438 | A * | 11/1989 | Winchester | H01H 9/06 310/50 |
| 10,014,128 | B2 * | 7/2018 | Kannan | B25F 5/02 |
| 10,875,108 | B2 * | 12/2020 | Hart | B23D 47/02 |
| 2010/0018609 | A1 | 1/2010 | Vaan der Linde | |
| 2011/0005905 | A1 * | 1/2011 | Fukinuki | B25F 5/02 200/43.18 |
| 2013/0277081 | A1 | 10/2013 | Hayashi et al. | |
| 2013/0277189 | A1 * | 10/2013 | Yuan | H01H 3/20 200/332 |
| 2015/0170848 | A1 * | 6/2015 | Kannan | H01H 3/20 200/43.17 |
| 2015/0209949 | A1 | 7/2015 | Milbourne et al. | |
| 2015/0290791 | A1 * | 10/2015 | Takahashi | B25F 5/02 173/170 |
| 2017/0106491 | A1 | 4/2017 | Ishikawa et al. | |
| 2017/0125192 | A1 * | 5/2017 | Hanai | H01H 9/06 |
| 2018/0096802 | A1 | 4/2018 | Lau | |
| 2018/0200810 | A1 * | 7/2018 | Niwa | B23D 59/001 |
| 2018/0264638 | A1 | 9/2018 | Boeck et al. | |
| 2019/0047115 | A1 * | 2/2019 | Nakamura | B25F 5/02 |
| 2019/0070705 | A1 * | 3/2019 | Ishikawa | H01M 50/20 |

FOREIGN PATENT DOCUMENTS

| | | | |
|---|---|---|---|
| DE | 102006060880 | A1 | 6/2008 |
| DE | 102012223931 | A1 | 6/2014 |
| DE | 10 2015214368 | A1 | 6/2016 |
| DE | 102016119582 | A1 | 4/2017 |
| DE | 10 2015 222153 | A1 | 5/2017 |
| DE | 10 2017114226 | A1 | 4/2018 |
| EP | 0157186 | A2 | 10/1985 |
| EP | 2946878 | A1 | 11/2015 |
| EP | 3217412 | A1 | 9/2017 |
| EP | 3260240 | A1 | 12/2017 |
| GB | 2400811 | A | 10/2004 |
| GB | 2400811 | B | 7/2005 |
| JP | 2006281414 | A | 10/2006 |
| JP | 2009534204 | A | 9/2009 |
| JP | 2013129017 | A | 7/2013 |
| JP | 2013223899 | A | 10/2013 |

* cited by examiner

SWITCH FOR MACHINE TOOL AND SWITCHING LOGIC

The present invention relates to a method for controlling a machine tool, in particular a sander, wherein the machine tool comprises a control apparatus, a drive, a tool which is driven by the drive, for example an abrasive means, an operating switch and also a lock switch.

The present invention further relates to a machine tool, in particular in the form of a sander, for carrying out the method according to the invention.

BACKGROUND

Machine tools usually have an operating switch by way of which the machine tool or the drive of the machine tool can be activated or deactivated. The operating switch is usually a pressure switch without a latching function, which pressure switch has to be permanently pressed by a user for operation.

However, in some machine tools, in particular in sanders, it may be desirable for the operating switch to remain permanently operated for activating the machine tool, even if no more pressure is exerted onto the operating switch.

However, the apparatuses already available on the market for allowing the operating switch of a machine tool to be activated even without pressure being permanently exerted are problematic and often inadequate when considering the prespecified safety aspects in respect of handling.

SUMMARY OF THE INVENTION

An object of the present invention is to solve the above-described problem and to provide a method for controlling a machine tool and also a machine tool for carrying out the method.

The present invention provides a method for controlling a machine tool, in particular a sander, wherein the machine tool comprises a control apparatus, a drive, a tool which is driven by the drive, for example an abrasive means, an operating switch and also a lock switch.

According to the invention, the method is characterized by the following method steps:

- activating the operating switch by exerting a force in a direction (N) onto the operating switch for switching over the machine tool from a deactivation mode to an activation mode, so that the drive is adjusted to a first predetermined rotation speed value;
- deactivating the operating switch, so that no more force is exerted in direction (N) onto the operating switch, wherein the drive is adjusted in the first predetermined rotation speed value for a predetermined time period;
- activating the lock switch within the first predetermined time period after deactivation of the operating switch, so that the drive is adjusted to a predetermined second rotation speed value; and
- activating the operating switch by exerting a force in a direction onto the operating switch or activating the lock switch by exerting a force in a direction onto the lock switch for switching over the machine tool from the activation mode to the deactivation mode.

The lock switch can also be referred to as a lock-on switch or locking switch. The predetermined time period can be between 0.5 and 3 seconds, and in particular one second, here. However, it is also possible for the time period to be able to be extended or shortened by an interface (also called MMI—man-machine interface) on the housing of the machine tool and with the aid of the control apparatus.

According to an advantageous embodiment of the method according to the invention, it may be possible for the first rotation speed value and the second rotation speed value to be identical.

According to an advantageous embodiment of the method according to the invention, it may be possible for the first rotation speed value and the rotation second speed value to be different. The first rotation speed value can be 2625 RPM and the second rotation speed value can be 5250 RPM here.

Within the meaning of the invention, it is preferred for the operating switch and the lock switch to be designed as a common switch apparatus. For example, this one switch apparatus can be formed by two relatively large pressure surfaces, which correspond to the individual operating switch and the lock switch. For example, a first pressure surface can correspond to the operating switch, while the second pressure surface corresponds to the lock switch. The two pressure surfaces can preferably be connected to one another by a relatively narrow central web. Within the meaning of the invention, it is particularly preferred for the common switch apparatus to be designed as a rocker or rocker switch. The rocker can be referred to, in particular, as a continuous rocker since the two pressure surfaces are connected to one another by the central web and the one common switch apparatus therefore has a continuous surface. The common, continuous surface is preferably composed of the three partial surfaces which are associated with the two pressure surfaces and the central web. It is preferred within the meaning of the invention for the pressure surfaces to also be able to be referred to as switching surfaces or as buttons. The switching surfaces are advantageously designed to take over the functions of the operating switch and of the lock switch.

In a preferred refinement of the invention, the proposed control method can be described by the following steps:

- activating a first pressure surface of the switch apparatus, wherein the switch apparatus is designed as a continuous rocker switch and wherein the machine tool is moved from a deactivation mode to an activation mode by exerting the force onto the first pressure surface,
- deactivating the first pressure surface, so that no more force is exerted onto the first pressure surface;
- activating a second pressure surface of the switch apparatus within a first predetermined time period after deactivation of the first pressure surface, as a result of which the machine tool is put into a working mode.

A user can now work with the machine tool and, for example, carry out sanding work. The machine tool can be used, in particular, in the working mode. Within the meaning of the invention, it is preferred for the working mode, in contrast to the activation mode, the continuous operation of the machine tool. The machine tool preferably runs in a "momentary on" state in the working mode, whereas the machine tool operates in a "lock on" state during continuous operation. The user can remove his finger from the second pressure surface while working with the machine tool since the machine tool advantageously remains in the working mode even without permanent operation of the second pressure surface. Within the meaning of the invention, it may be preferred for the working mode of the machine tool to correspond to the predetermined second rotation speed value. The activation mode of the machine tool preferably corresponds to the predetermined first rotation speed value. In the deactivation mode, the machine tool is preferably switched off and the rotation speed value is zero. Within the meaning of the invention, it is preferred for the machine tool to be able to be switched off or moved to the deactivation mode by operating the first or the second pressure surface. In particular, the machine tool can be switched over from the working mode to the deactivation mode by operating the first or the second pressure surface.

Within the meaning of the invention, it is preferred for the machine tool to automatically switch off or establish a deactivation mode if the second pressure surface of the rocker switch apparatus is not operated within a predetermined time period after deactivation of the first pressure surface.

In a preferred embodiment, the first pressure surface of the switch apparatus, which preferably corresponds to the operating switch, can be designed as an "I/O button". Furthermore, the second pressure surface of the switch apparatus, which preferably corresponds to the lock switch, can be designed as a "locking switch". The first pressure surface and the second pressure surface can preferably be combined to form a continuous rocker. The rocker can be integrated in an elastomer mat or can be of mechanical design. FIGS. 8 and 9 show an exemplary embodiment of this preferred embodiment of the invention.

This invention has the advantage that, in the context of this embodiment of the invention, the provision of a light source between the operating switch and the lock switch can be dispensed with. As a result, the structure and the electronics system on which the proposed tool handle is based, in particular the switching electronics system, can be substantially simplified. In this embodiment of the invention, the feedback regarding the operating state of the machine tool is preferably provided with the aid of a second light source, which can preferably be arranged above the second pressure surface of the common rocker switch apparatus. In particular, the second light source is present arranged between the second pressure surface and the preferably adjacent third and fourth switches. The third and fourth switches of the proposed tool handle of the machine tool are preferably designed to select a gear for operating the machine tool.

The feedback can take place, for example, by the second light source flashing at regular intervals or at a specific frequency as long as the machine tool is in a temporary activation mode. This state of the machine tool is preferably referred to as a "hold to run" function or state of the first pressure surface of the switch apparatus. The second light source can also light up permanently as soon as the second pressure surface of the rocker switch is pressed. In the deactivation mode, the second light source is preferably switched off.

In one exemplary embodiment of the invention, the machine tool can be in a first state if the machine tool is connected to an energy source. In this first state, preferably neither the operating switch nor the lock switch is pressed. If the handle of the machine tool has a common switch apparatus, preferably neither the first pressure surface nor the second pressure surface is pressed. In this first state, it is preferred within the meaning of the invention for the light source or the LED on the handle of the machine tool to not light up. In this first state, the machine tool is preferably in the deactivation mode.

The machine tool can be put into a second state by operating the operating switch or the first pressure surface of the rocker switch. In this second state, the motor of the machine tool begins to operate, wherein it operates, in particular, in a "hold to run" state, which is also referred to as "temporary operation" within the meaning of the invention. In this second state of the machine tool, the light source or the LED can indicate by way of flashing that the machine tool is ready to be put into a working mode. The flashing can take place, for example, at a frequency of 1 Hz, without being restricted to this frequency. The duration of the "hold to run" state can be limited, for example, to a duration of, for example, 1 second. The second state preferably corresponds to the activation mode of the machine tool.

If, in this second state of the machine tool, the lock switch or the second pressure surface of the rocker switch is operated briefly once, in particular within the defined period of 1 second after the operating switch or the first pressure surface has been released, the machine tool preferably operates not only temporarily but rather permanently. This state is referred to as the third state of the machine tool, wherein the third state preferably corresponds to the working mode. The third state can be indicated by the light source or the LED on the handle of the machine tool lighting up permanently. The third state can preferably be terminated by pressing either the operating switch or the lock switch. In the case of the handle of the machine tool having a rocker switch, it may be preferred for either the first pressure surface or the second pressure surface to be able to be pressed in order to terminate the third state—and therefore the working mode. The deactivation state, which can be indicated by the light source or the LED no longer being lit, can be restored by terminating the third state, in which the machine tool or the motor preferably operates permanently.

In its refinement with the rocker switch, the invention preferably renders possible the provision of an increased level of safety since the pressed second button particularly effectively prevents the machine tool from being unintentionally permanently switched on. Furthermore, the one light source or LED can advantageously be used to indicate faults and/or fault messages. Flashing of the light source or LED preferably indicates that the machine tool is in the "hold to run" mode, whereas permanent illumination preferably means that the machine tool is in continuous operation. In other words, it is preferred within the meaning of the invention for the machine tool or its handle to comprise at least one light source for indicating a ready-to-operate state of the machine tool. The ready-to-operate states can be, for example, the first, second and third state of the machine tool or the activation mode, the deactivation mode and the working mode, wherein the activation mode preferably corresponds to the "hold to run" mode of the machine tool. A particular advantage of the invention is that the machine tool can be operated with the same switching logic system, irrespective of whether the machine tool has an operating switch and a lock switch or a common switch apparatus.

Furthermore, the object on which the present invention is based is achieved by a machine tool for carrying out the method, wherein the machine tool comprises a control apparatus, a drive, a tool which is driven by the drive, for example an abrasive means, an operating switch and also a lock switch. In a very particularly preferred exemplary embodiment of the invention, it is preferred for the machine tool, the operating switch and the lock switch to form a common switch apparatus which is preferably designed as a rocker switch. For this purpose, the operating switch and the lock switch can each be formed by a pressure surface, which pressure surfaces are connected to one another by means of a central web.

Further advantages can be found in the following description of figures. Various exemplary embodiments of the present invention are illustrated in the figures. The figures, the description and the claims contain numerous features in combination. A person skilled in the art will expediently also consider the features individually and combine them to form useful further combinations.

BRIEF DESCRIPTION OF THE DRAWINGS

In the figures, components that are the same and components of the same type are designated by the same reference signs. In said figures.

DETAILED DESCRIPTION

Figure 1:
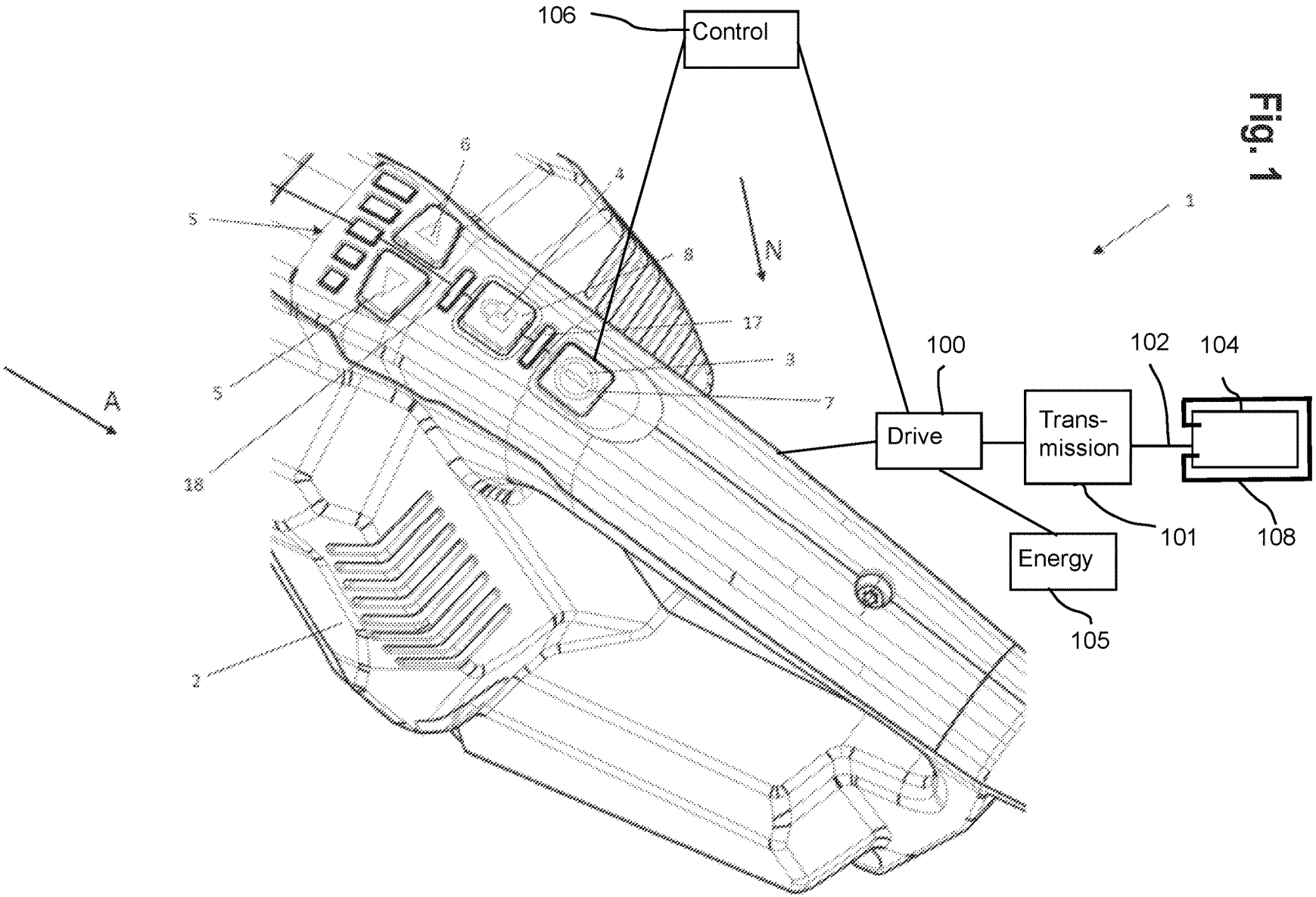
FIG. 1 shows a perspective view of a handle of a machine tool according to the invention with an operating switch and a lock switch.
Figure 2:
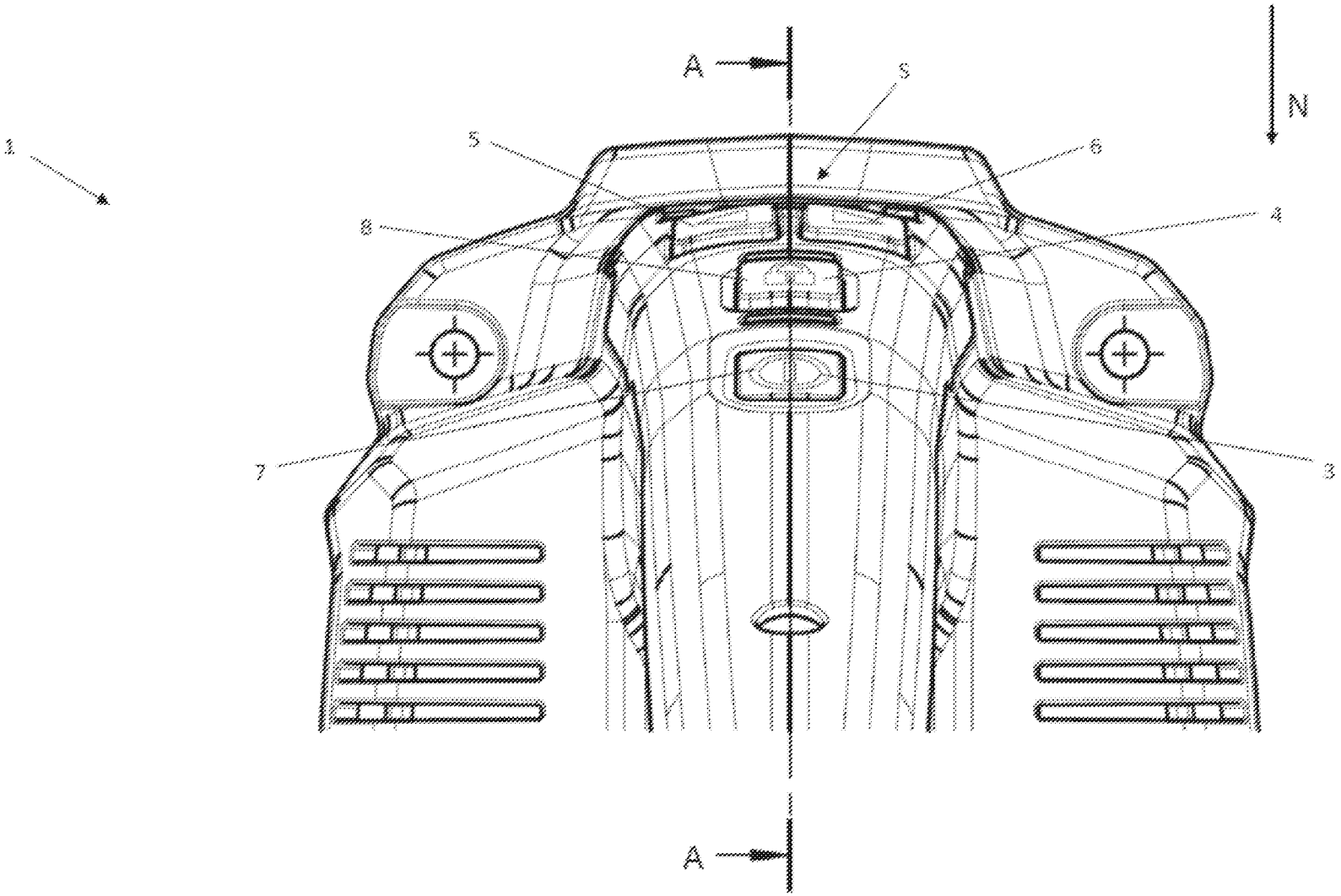
FIG. 2 shows a view from the rear of the handle of the machine tool according to the invention with the operating switch and the lock switch.

FIGS. 1 and 2 show a portion of a machine tool 1 in the form of a sander. However, it is also possible for the machine tool 1 to be configured as a drill, saw or the like.

The machine tool 1 substantially contains a housing 2, a drive 100, a transmission 101, a drive shaft 102, a tool holder 104, an energy source 105 and a control apparatus 106. In this case, the drive can be configured, for example, in the form of a brushless electric motor. The drive is positioned in the housing 2 such that a torque which is generated by the drive is transmitted to the tool via the drive shaft and the tool holder. The control apparatus controls or regulates all functions of the machine tool 1 and, in particular, the functions of the drive. The energy source serves to supply electrical energy to the electrical consumers of the machine tool 1. One electrical consumer is, in particular, the drive. Here, the energy source can be configured in the form of a rechargeable battery (also called storage battery). The energy source, which is configured as a rechargeable battery, can be connected to the housing 2 of the machine tool 1. As an alternative, the energy source can also be implemented as a power cable for releasably connecting the machine tool 1 to a mains power connection (i.e. plug socket).

The control apparatus controls and regulates, in particular, the supply of electrical energy, i.e. electric current, to the drive, as a result of which specifically the rotation speed of the drive which is designed as an electric motor is controlled or regulated.

The drive 100, the transmission 101, the drive shaft 102, the tool holder 104, the energy source 105, the control apparatus 106 and the tool 108, such as an abrasive means on tool holder 104, are shown schematically in FIG. 1.

The subregion shown in FIGS. 1 and 2 is a rear portion of the housing 2 of the machine tool 1 and, in particular, one of the handles of the machine tool 1 which is configured as a sander. The handle serves to hold and guide the machine tool 1. A further handle is usually provided on a front section of the machine tool 1 which is configured as a sander.

As can be seen in FIG. 1, a first, second, third and fourth switch 3, 4, 5, 6 is positioned on the handle of the machine tool 1. The first, second, third and fourth switches 3, 4, 5, 6 are each configured as a pressure switch. Furthermore, a multi-level scale S is also provided on the handle.

The first switch 3 is an operating switch 7 by way of which the machine tool 1 can be selectively and reversibly moved to an activation or deactivation mode. The operating switch 7 can also be referred to as an "I/O button". If the machine tool 1 is moved to the activation mode, a corresponding signal is sent from the operating switch 7 to the control apparatus. The control apparatus ensures that the drive 100 is activated by the supply of the electrical energy (i.e. supply of current) from the energy source, as a result of which a torque is generated by the drive. In other words: in the activation mode, the machine tool 1 is switched on, so that work can be carried out using said machine tool. The operating switch 7 can preferably be formed by a first pressure surface 13 if the functions of the operating switch 7 and of the lock switch 8 are taken over by a common switch apparatus 11 which is preferably formed by a rocker switch.

If, however, the machine tool 1 is moved to the deactivation mode, a corresponding signal is sent from the operating switch 7 to the control apparatus. The control apparatus ensures that—advantageously after a predefined delay time, such as, for example, 1 second for moving the thumb—no more electrical energy (=current) is conducted from the energy source to the drive. In other words: in the deactivation mode, the machine tool 1 is switched off, so that no more work can be carried out using said machine tool. The control apparatus is still active for a certain time, even if the drive has already been shut down.

The operating switch 7 is correspondingly connected to the control apparatus for signal transmission by means of lines (not shown). In order to operate the operating switch 7, a certain force or a certain pressure is exerted by a user of the machine tool 1 in arrow direction N onto the surface of the operating switch 7 or of the first pressure surface 13 of the common switch apparatus 11, so that the operating switch 7 is moved in arrow direction N. As soon as no more force is exerted onto the operating switch 7, the operating switch 7 moves counter to the arrow direction N back to the starting position. For this purpose, the operating switch 7 can be configured with a corresponding spring (not shown). As an alternative, the operating switch 7 can also be formed from an elastic material, for example rubber. The machine tool 1 is generally only activated as long as the operating switch 7 or the first pressure surface 13 of the common switch apparatus 11 remains pressed in arrow direction N. The operating switch 7 is therefore not a switch with a latching function which remains in a desired (i.e. pressed) position by being pressed once.

The second switch 4 is a lock switch 8 which serves to lock the machine tool 1 or the control apparatus and the drive in the activation mode. In a preferred embodiment of the invention, the lock switch 8 can be designed as a second pressure surface 14 of a rocker switch 11. After activation of the lock switch 8, the machine tool 1 and also the control apparatus and the drive remain in the activation mode, even if the operating switch 7 is no longer pressed or no more force is exerted onto the operating switch 7 in arrow direction N. This constitutes a substantial advantage of the invention by way of which the object of providing a machine tool 1 which can be used by a user without permanent operation of a pressure surface (13 or 14) being necessary is achieved.

Furthermore, the lock switch 8 as well as the operating switch 7 can be used in order to move the machine tool 1 from the activation mode to the deactivation mode. In a particularly preferred embodiment of the invention, the rocker switch 11 can be used for this purpose. In other words: by operating, for example, the lock switch 8, the machine tool 1 is moved from the activation mode to the deactivation mode. In order to operate the lock switch 8, a certain force or a certain pressure is exerted by a user of the machine tool in arrow direction N onto the surface of the lock switch 8, so that the lock switch 8 is moved in arrow direction N.

Various modes and functions of the machine tool 1 are illustrated in FIGS. 4 to 7.

Figure 4:
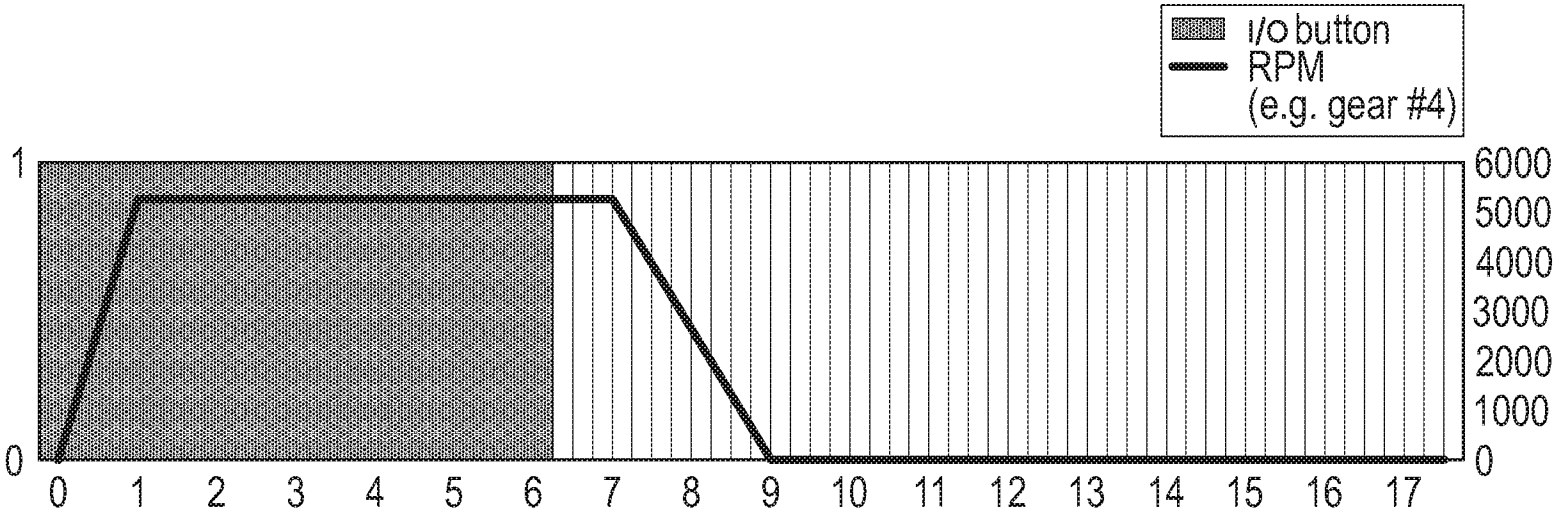
FIG. 4 shows a first graph for illustrating a first aspect of the method according to the invention.

FIG. 4 illustrates, with the aid of the graph, the situation that the operating switch 7 or the first pressure surface 13 of the common switch apparatus 11 remains pressed by the user for six seconds. The machine tool 1 and the control apparatus and the drive are therefore in the activation mode for six seconds. Within the first second, the rotation speed of the drive which is configured as an electric motor increases linearly from zero to 5250 revolutions per minute (RPM). The rotation speed of the drive remains constant at 5250 RPM for five seconds. Starting from the sixth second, no more force or pressure is exerted by the user onto the operating switch 7. After the operating switch 7 is no longer pressed, the rotation speed for the drive remains at the value of 5250 RPM. The value of the rotation speed for the drive decreases in a linear manner from 5250 RPM to zero only after one second, i.e. from the sixth to the seventh second. The value zero is reached for the rotation speed starting from the ninth second. When the rotation speed for the drive has reached zero, the drive and therefore the machine tool 1 are in a deactivation mode.

The profile illustrated with the aid of the graph in FIG. 4 constitutes the situation in which the operating switch 7 has been pressed by the user only for a time period of six seconds and the machine tool 1 is accordingly in an activation mode for a total of nine seconds.

Figure 5:
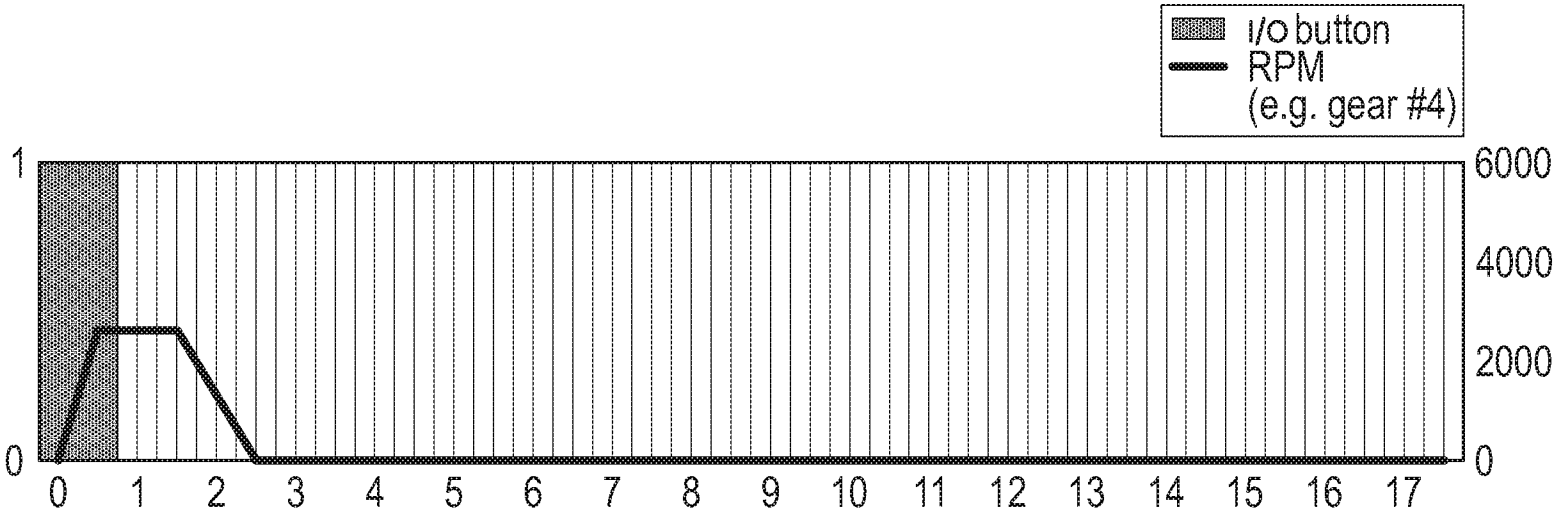
FIG. 5 shows a second graph for illustrating a second aspect of the method according to the invention.

FIG. 5 illustrates, with the aid of the graph, a situation in which the user presses or operates the operating switch 7 or the first pressure surface 13 of the common switch apparatus 11 only for 0.8 seconds. The rotation speed for the drive which is configured as an electric motor increases from zero to a value of 2625 RPM in the period from zero to 0.75 seconds. The rotation speed remains constant at 2625 RPM for a total of one second, i.e. for the period from 0.75 to 1.75 seconds. Starting from 1.5 seconds, the rotation speed value drops from 2625 RPM to zero. The drive finally stops at 2.5 seconds and the machine tool 1 and also the drive change from the activation mode to the deactivation mode.

Figure 6:
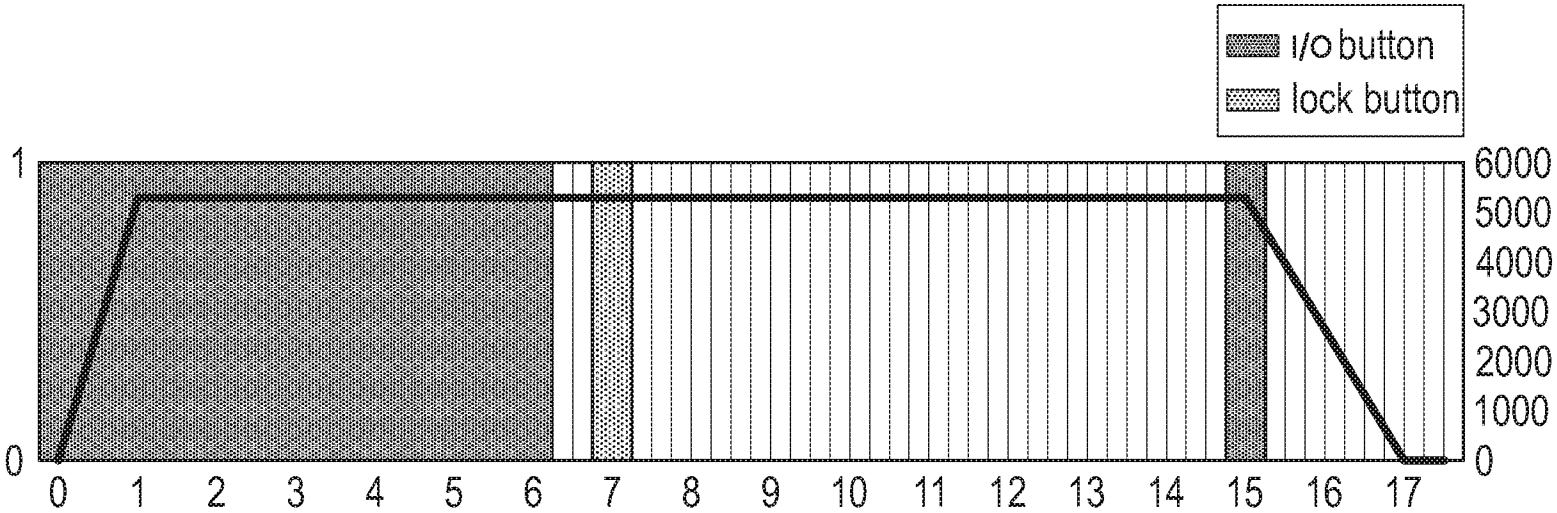
FIG. 6 shows a third graph for illustrating a third aspect of the method according to the invention.

FIG. 6 illustrates, with the aid of the graph, a situation in which the user presses or operates the operating switch 7 or the first pressure surface 13 of the common switch apparatus 11 only for 6 seconds. The rotation speed value for the drive increases linearly from zero to 5250 RPM within one second. The operating switch 7 remains pressed for a total of 6 seconds. The machine tool 1 and also the control apparatus and the drive therefore change from the deactivation state to the activation mode.

After 6 seconds, no more pressure or no more force is exerted by the user onto the operating switch 7. Within one second, i.e. starting from the seventh second, after the operating switch 7 is no longer pressed, the lock switch 8 is pressed once by the user. By way of operating or pressing the locking switch 8 or the second pressure surface 14 of the common switch apparatus 11, the machine tool 1 and the drive remain in the activation mode or can be moved to a working mode by the user. Furthermore, the rotation speed value for the drive remains at 5250 RPM as before. After 15 seconds or starting from the fifteenth second, the operating switch 7 is pressed again. By way of operating the operating switch 7 again, the machine tool 1 and the drive change from the activation mode to the deactivation mode. As an alternative, instead of operating the operating switch 7, the lock switch 8 can also be operated in order to allow the machine tool 1 and the drive to change from the activation mode to the deactivation mode. The rotation speed value for the drive drops linearly and from 5250 RPM to zero within one second. The drive stops starting from the seventeenth second.

Figure 7:
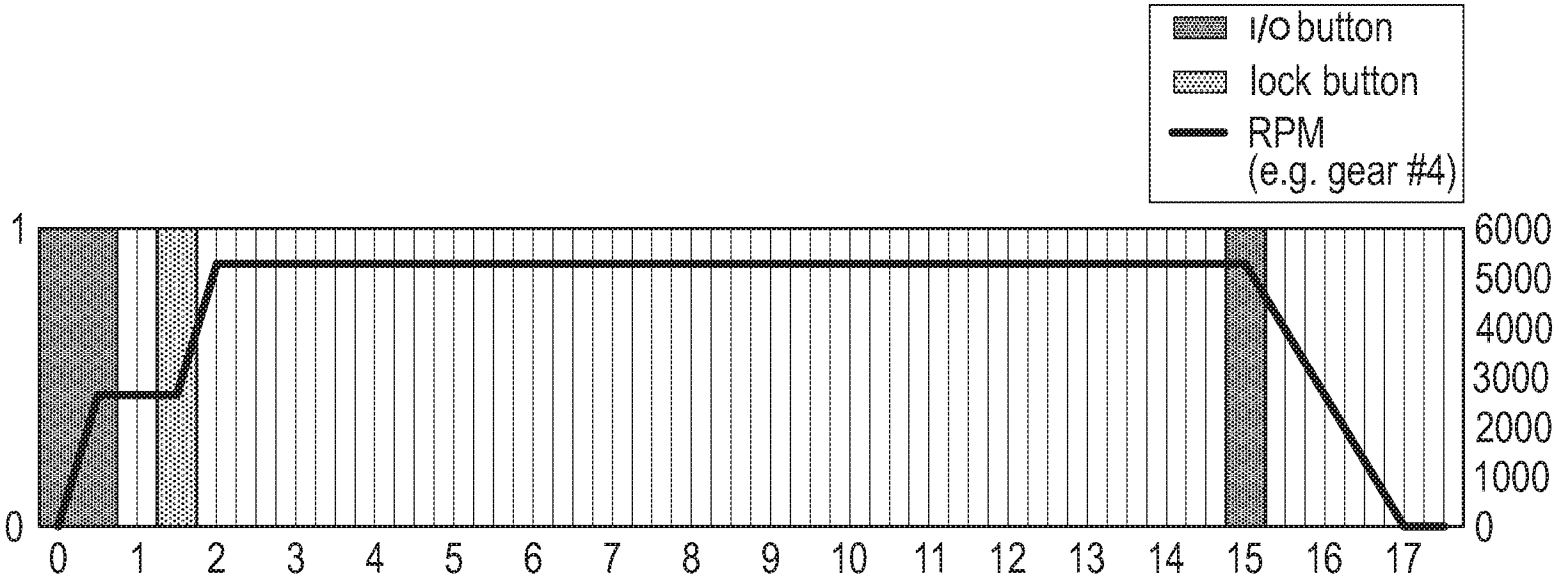
FIG. 7 shows a fourth graph for illustrating a fourth aspect of the method according to the invention.

FIG. 7 illustrates, with the aid of the graph, a situation in which the user presses or operates the operating switch 7 or the first pressure surface 13 of the common switch apparatus 11 only for 0.75 seconds. The machine tool 1 and the drive change from the deactivation mode to the activation mode. The rotation speed value increases only from zero to 2625 RPM. The rotation speed for the drive remains at 2625 RPM for one second. Within one second, i.e. starting from 0.75 seconds after the operating switch 7 is no longer pressed, the locking switch 8 or the second pressure surface 14 of the common switch apparatus 11 is pressed once by the user. By way of operating or pressing the lock switch 8, the machine tool 1 and also the drive remain in the activation mode. Furthermore, the rotation speed value for the drive increases linearly from 2625 to 5250 RPM. As before, the operating switch 7 is pressed again after 15 seconds or starting from the fifteenth second. By way of operating the operating switch 7 again, the machine tool 1 and the drive change from the activation mode to the deactivation mode. As an alternative, instead of operating the operating switch 7, the lock switch 8 can also be operated in order to allow the machine tool 1 and the drive to change from the activation mode to the deactivation mode. The rotation speed value for the drive drops linearly and within two seconds from 5250 RPM to zero. The drive stops starting from the seventeenth second.

Figure 3:
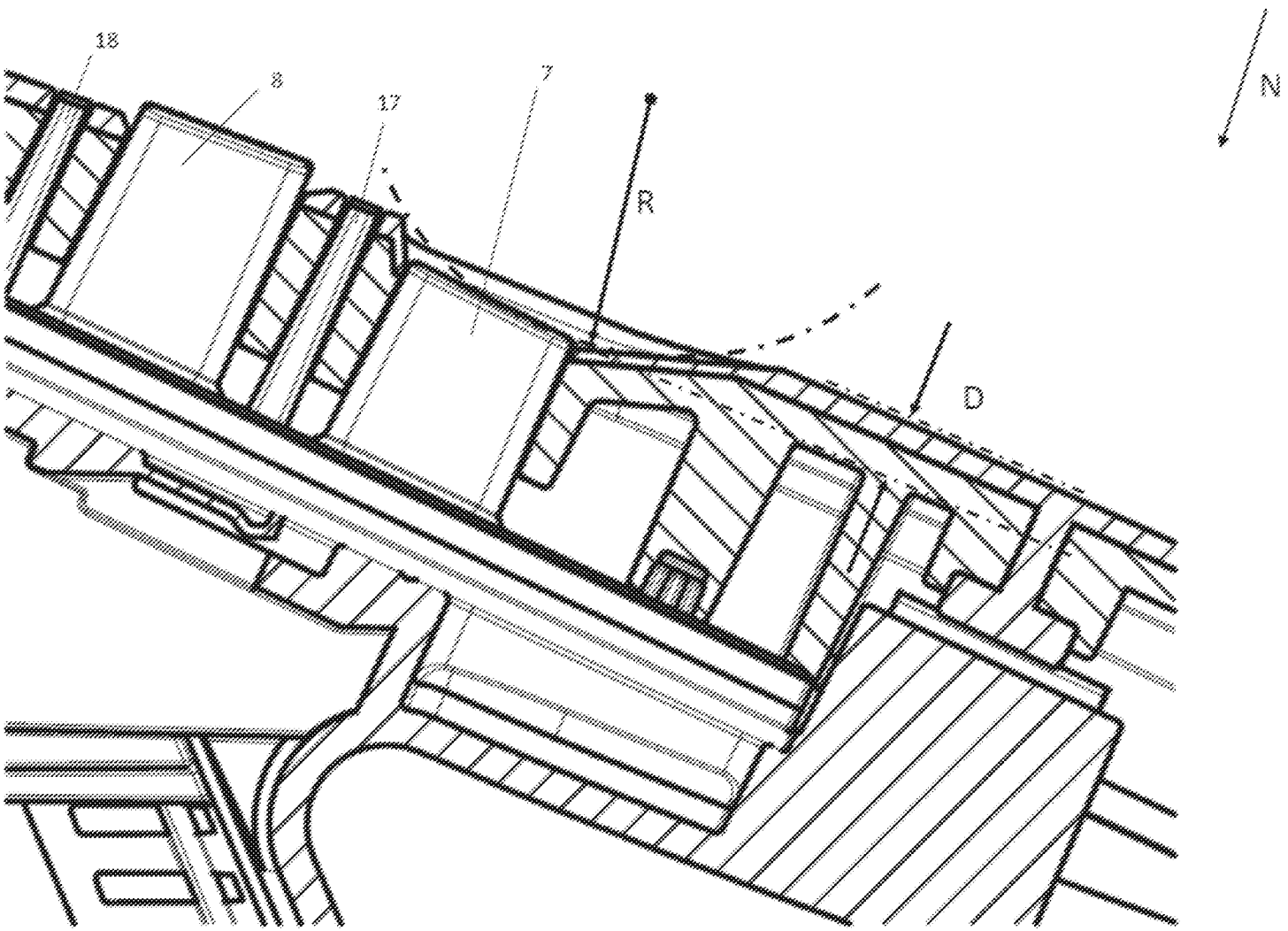
FIG. 3 shows a sectional view along the section line A-A according to FIG. 2.

As illustrated in FIG. 3, the housing 2 of the machine tool 1 is configured such that the operating switch 7 is located in a recess 10. If the operating switch 7 and the lock switch 8 are formed by a common switch apparatus 11, it is likewise preferred for the rocker switch to be present in a recess 12. The surface of the operating switch 7 can be positioned lower in direction N than the surface of the housing 2 of the machine tool 1. The distance D between the surface of the operating switch 7 and the surface of the housing 2 of the machine tool 1 here is, for example, between 5 and 20 mm. However, a recess of the operating switch with a depth or height in a range from 1 to 15 mm is very particularly preferred. In a particularly advantageous refinement, the distance D has a value of 10 mm. The edge surfaces 9 of the recess 10 on the surface of the machine tool 1 are beveled and inclined in relation to the operating switch 7. As shown in FIG. 3, the inclination of the beveled edge surfaces is configured here such that a circle with the radius R bears against individual points of the edge surfaces and also at a single point on the surface of the operating switch 7. This special configuration of the recess 10 of the surface of the operating switch 7 serves to make it difficult to operate the operating switch 7 and therefore to not be inadvertently operated. A user has to engage by way of a finger into the recess of the housing 2 in a targeted manner in order to operate the operating switch 7 in a targeted and deliberate manner. Furthermore, the recess serves to ensure that the operating switch 7 is not inadvertently operated when the machine tool 1 is set down on a substrate upside-down, i.e. on the surface of the housing 2 on which the operating switch 7 is located. Unevennesses, such as stones which are located on the ground, cannot trip the operating switch 7 owing to the special recess of the operating switch.

In order to additionally prevent the machine tool 1 from being inadvertently switched on, all or individual switches—apart from the recessed operating switch 7 or the first pressure surface 13 of the switch apparatus 11—can be of raised design. The switches are preferably interconnected in such a way that the operating switch 7 or the first pressure surface 13 of the switch apparatus 11 is active only when no other switch is pressed at the same time.

It may be preferred within the meaning of the invention for the operating switch 7 and the lock switch 8 to be formed by a common switch apparatus 11. The surface of this common switch apparatus 11 can be flat or planar. However, it may also be preferred for the rocker switch 11 to have recesses in the surface in the region of the first pressure surface 13 and the second pressure surface 14, which recesses are advantageously designed to guide the finger of a user. As a result, the user can preferably orientate himself better on the surface of the common switch apparatus and operate the rocker switch 11 particularly accurately.

The third and fourth switches 5, 6 are gear selector switches by way of which the individual gears of the transmission of the machine tool can be selected. Selection and also engagement of the gears preferably takes place electronically. By way of exerting a force or a pressure in arrow direction N onto the fourth switch 6, a higher gear is selected and engaged. By way of exerting a force or a pressure in arrow direction N on the third switch 5, a lower gear is selected and engaged. The multi-stage scale S consists of a plurality of light sources (e.g. LEDs) and accordingly indicates, by lighting up the individual light sources, which gear is selected in the transmission or in the engine electronics system.

It can further be seen in FIG. 1 that a first light source 17 in the form of an LED is positioned above the operating switch 7 and a second light source 18 in the form of an LED is positioned above the lock switch 8. The first light source 17 lights up when the operating switch 7 is pressed and the machine tool 1 has been moved from the deactivation mode to the activation mode. The second light source 18 lights up when the lock switch is pressed and the machine tool has been locked in the activation mode.

The first light source 17 and the second light source 18 can optionally be used to indicate faults. By way of example, a temporary fault in the machine tool 1 can be indicated by a flash code. A temporary fault may be, for example, overheating. A permanent fault may preferably be indicated by permanent lighting of one of the two light sources 17, 18. A permanent fault may be, for example, a service request. It may be preferred within the meaning of the invention for the light sources 17, 18 to be of two-color design. Within the meaning of the invention, this preferably means that the light sources 17, 18 are designed to emit light in at least two different colors, for example red and green. For example, the color "green" can be used for normally indicating the operating state and the color "red" for indicating faults. The two-color characteristic can be achieved either by multicolored lighting means or by different-colored, individual lighting means under a common light guide body. In the preferred embodiment of the invention with a common switch apparatus 11, the provision of the light source 17 can be dispensed with. The statements made above then apply, mutatis mutandis, to the sole light source 18. It is very particularly preferred within the meaning of the invention for the light sources 17, 18 to be formed by or comprise light emitting diodes (LED).

As an aid to the user, the switches (3-8, 13, 14) and/or light sources 17, 18 themselves or adjacent regions can be provided with symbols or labels.

Figure 8:
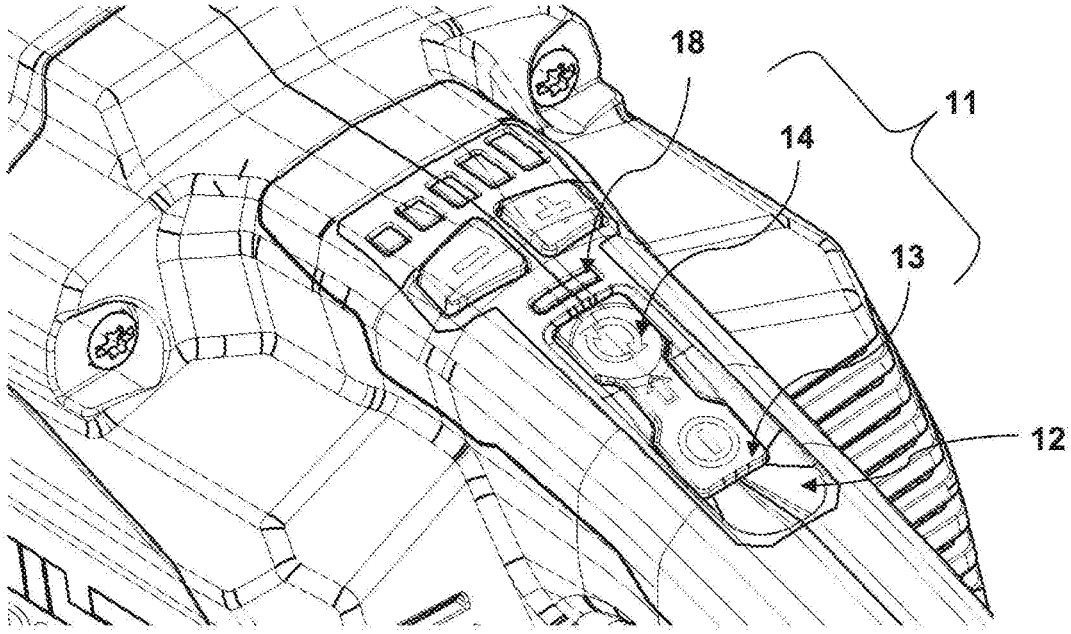
FIG. 8 is an illustration of a preferred embodiment of the machine tool, in particular of the handle of the machine tool.

FIG. 8 shows a preferred embodiment of the machine tool 1, in particular the handle (illustrated by reference sign 15 in FIG. 9) of the machine tool 1. The common switch apparatus 11, which comprises a first pressure surface 13 and a second pressure surface 14, and also a central web, which connects the two pressure surfaces (13, 14) to one another, are illustrated in particular. The common switch apparatus 11 preferably constitutes a rocker switch. In the embodiment of the invention with a common switch apparatus 11, the handle 15 of the machine tool 1 comprises only one light source which may be, for example, the second light source 18. This one light source 18 can be arranged, for example, between the second pressure surface 14, which preferably corresponds to the lock switch 8, and the third switch 5 and the fourth switch 6.

Figure 9:
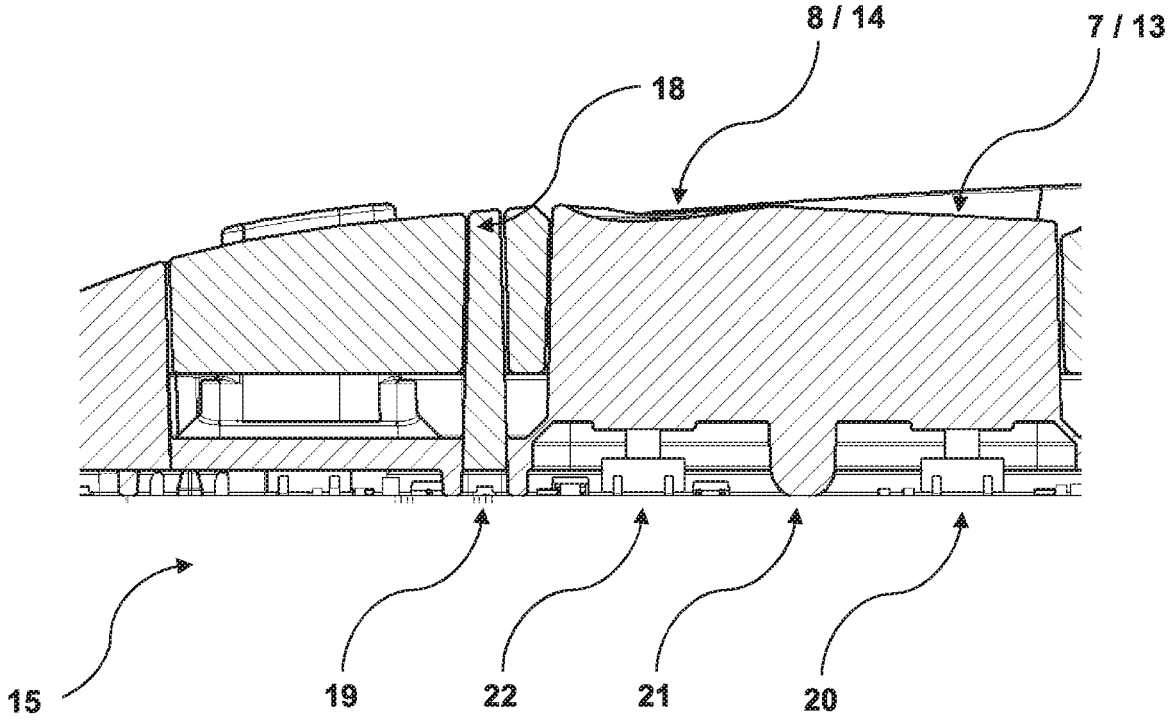
FIG. 9 is an illustration of a preferred embodiment of the machine tool, in particular of the handle of the machine tool.

FIG. 9 shows a side view of a preferred embodiment of the handle 15 of the machine tool 1. Said figure shows, in particular, the light source 18 which can preferably be connected to an integrated light sources 19. The integrated light sources 19 can be formed, for example, by a light emitting diode (LED). Furthermore, FIG. 9 shows the arrangement of the first pressure surface 13 and the second pressure surface 14 of the rocker switch 11. The second pressure surface 14 can be connected to a second microbutton 22, whereas the first pressure surface 13 of the common switch apparatus 11 can be connected to a first microbutton 20. The pivot point 21 of the rocker 11 or the rocker switch 11 can be present between the two microbuttons (20, 22). The switches (7, 8) or the pressure surfaces (13, 14) can preferably interact with the microbuttons (20, 22). It is preferred within the meaning of the invention that, by configuring the common switch apparatus 11 as a rocker switch, either the first pressure surface or the second pressure surface 14 is identified by the machine tool 1 as being pressed, but not both pressure surfaces (13, 14) at the same time. For this purpose, the common switch apparatus 11 preferably has a pivot point 21 for the rocker switch. The rocker switch 11 can preferably be present in a recess 12. It is furthermore preferred for the switches (7, 8) or the pressure surfaces (13, 14) to be constituent parts of the handle 15 of the machine tool 1.

LIST OF REFERENCE SIGNS

1 Machine tool
2 Housing
3 First switch
4 Second switch
5 Third switch
6 Fourth switch
7 Operating switch
8 Lock switch
9 Edge surface
10 Recess
11 Common switch apparatus/rocker switch
12 Recess for the common switch apparatus
13 First pressure surface
14 Second pressure surface

15 Handle of the machine tool
17 First light source
18 Second light source
19 Integrated light source
20 First microbutton
21 Pivot point of the rocker switch
22 Second microbutton
23
100 drive
101 transmission
102 drive shaft
104 tool holder
105 energy source
106 control apparatus
108 tool

What is claimed is:

1. A method for controlling a machine tool, the machine tool including a control apparatus, a drive, a tool driven by the drive, an operating switch and a lock switch, the method comprising:

activating the operating switch by exerting a force in a direction (N) onto the operating switch for switching over the machine tool from a deactivation mode to an activation mode, so that the drive is adjusted to a first predetermined rotation speed value;

deactivating the operating switch, so that no more force is exerted in the direction (N) onto the operating switch, wherein the drive is adjusted in the first predetermined rotation speed value for a predetermined time period;

activating the lock switch within the first predetermined time period after deactivation of the operating switch, so that the drive is adjusted to a predetermined second rotation speed value; and activating the operating switch by exerting a force in the direction (N) onto the operating switch or activating the lock switch by exerting a force in the direction (N) onto the lock switch for switching over the machine tool from the activation mode to the deactivation mode.

2. The method as recited in claim 1 wherein the first rotation speed value and the second rotation speed value are identical.

3. The method as recited in claim 1 wherein first rotation speed value and the second rotation speed value are different.

4. A machine tool for carrying out the method as recited in claim 1, the machine tool comprising:

the control apparatus;
the drive;
the tool driven by the drive;
the operating switch; and
the lock switch.

5. The machine tool as recited in claim 4 wherein the operating switch and the lock switch are formed by a common switch apparatus.

6. The machine tool as recited in claim 5 wherein the common switch apparatus is formed by a rocker switch.

7. The machine tool as recited in claim 5 wherein the common switch apparatus has a first pressure surface and a second pressure surface.

8. The machine tool as recited in claim 7 wherein the first pressure surface and the second pressure surface interact with microbuttons.

9. The machine tool as recited in claim 7 further comprising a handle, the operating switch and the lock switch being constituent parts of the handle.

10. The machine tool as recited in claim 5 wherein the common switch apparatus has a flat surface.

11. The machine tool as recited in claim 5 wherein the common switch apparatus has recesses for the first pressure surface or the second pressure surface.

12. The machine tool as recited in claim 4 wherein the operating switch (7) and the lock switch interact with microbuttons.

13. The machine tool as recited in claim 4 further comprising a handle, the operating switch and the lock switch being constituent parts of the handle.

14. The machine tool as recited in claim 4 further comprising at least one light source for indicating a ready-to-operate state of the machine tool.

15. The machine tool as recited in claim 4 wherein the tool is an abrasive means.

16. The method as recited in claim 1 wherein the machine tool is a sander and the tool is an abrasive means.

* * * * *